US006742511B1

(12) United States Patent
Remme

(10) Patent No.: US 6,742,511 B1
(45) Date of Patent: Jun. 1, 2004

(54) ARCHER'S SILENT ROLLER GUIDE

(76) Inventor: Michael J. Remme, P.O. Box 554, Fremont, WI (US) 54940

( * ) Notice: Subject to any disclaimer, the term of this patent is extended or adjusted under 35 U.S.C. 154(b) by 0 days.

(21) Appl. No.: 10/369,866

(22) Filed: Feb. 21, 2003

(51) Int. Cl.[7] ..... F41B 5/00
(52) U.S. Cl. ..... 124/44.5; 124/24.1
(58) Field of Search ..... 124/44.5, 24.1

(56) References Cited

U.S. PATENT DOCUMENTS

| | | | | | |
|---|---|---|---|---|---|
| 4,324,221 | A | | 4/1982 | Peck | 124/24 |
| 4,598,688 | A | * | 7/1986 | Paul et al. | 124/44.5 |
| 5,031,601 | A | | 7/1991 | Gunter | 124/44.5 |
| 5,085,201 | A | | 2/1992 | Topper et al. | 124/44.5 |
| 5,095,883 | A | * | 3/1992 | Kurtz | 124/44.5 |
| 5,117,803 | A | * | 6/1992 | Johnson | 124/44.5 |
| 5,251,606 | A | * | 10/1993 | Colvin | 124/44.5 |
| 5,261,383 | A | | 11/1993 | Halamay | 124/44.5 |
| 5,460,152 | A | * | 10/1995 | Specht | 124/44.5 |
| 5,462,041 | A | * | 10/1995 | Solecki | 124/44.5 |
| 5,601,069 | A | * | 2/1997 | Clark | 124/44.5 |
| 5,673,678 | A | * | 10/1997 | Savage | 124/44.5 |
| 5,676,121 | A | * | 10/1997 | Bizier | 124/44.5 |
| 6,082,348 | A | * | 7/2000 | Savage | 124/44.5 |
| 6,178,959 | B1 | * | 1/2001 | Troncoso et al. | 124/44.5 |
| 6,196,210 | B1 | * | 3/2001 | Chamberlain | 124/44.5 |
| 6,595,880 | B2 | * | 7/2003 | Becker | 124/44.5 |
| 6,615,813 | B1 | * | 9/2003 | Troncoso et al. | 124/44.5 |
| 2002/0096161 | A1 | * | 7/2002 | Hulm | 124/44.5 |
| 2002/0096162 | A1 | * | 7/2002 | Hulm | 124/44.5 |
| 2003/0024517 | A1 | * | 2/2003 | St. Cyr | 124/44.5 |

* cited by examiner

*Primary Examiner*—Derris H. Banks
*Assistant Examiner*—Urszula Cegielnik
(74) *Attorney, Agent, or Firm*—Russell L. Johnson, Patent Agent

(57) ABSTRACT

An archer's silent running roller guide is taught. The roller guide Is rendered silent by providing a v-shaped arrow guide wherein the v-shape is formed by the outer perimeters of two low inertia silent running roller bearings with a sound-muffling material wrapping the outer perimeter of the bearings. The v-shaped guide acting in cooperation with a coil spring serves to respond to the forces of displacement present at the instant the arrow is launched and to return the guide to its original position after the arrow is gone.

5 Claims, 2 Drawing Sheets

ARCHER'S SILENT ROLLER GUIDE

BACKGROUND OF THE INVENTION

1. Field of the Invention

This invention relates to an arrow guiding means for guiding arrows as the bow is drawn and as the arrow is released.

More particularly this invention relates to the arrow guiding means described above wherein the arrow guides are silent running bearings having a sound damping wrap secured around the arrow contacting surfaces of the bearings.

Still more particularly, this invention relates to the arrow guiding means described above wherein the arrow guides are mounted on adjustable mounts that permit the positioning on the arrow guides relative to the bow and relative to each other to provide adjustment for bow configuration and arrow diameters.

Still more particularly this invention relates to the arrow guiding means described above wherein the adjustable mounts are provided with a spring biasing means that will return the mounts to a preset position if they should be knocked out of position during transport or use.

2. Description of the Related Art

The bow hunting art abounds in arrow guides and rests for positioning an arrow during bow draw and arrow release.

One of the problems solved by this invention is that of sounds produced during arrow draw and release. Many game species have hearing that is acutely tuned to sounds such as those made by drawing an arrow along a guide. It is known in the art to pad an arrow guide with felts and other sound damping material. Fixed guides that are covered with sound damping material still produce some sounds during arrow draw and release.

Another problem solved by the guide of this invention is related to the bending of arrows during initial release. An arrow bends during the acceleration following the release of the bowstring. It is known in the art to provide v-shaped guides or v-shaped roller guides to insure that the arrow bending does not result in displacing the path of the arrow flight to the side. These v-shaped guides often are not adjustable to allow for the differing locations above the v-guide of the centers of arrows of differing diameter.

Another problem solved by the guide of this invention is related to misaligned guides. The sighting and guide components of hunting weapons are subject to being knocked out of alignment during transport and use due to falling or dropping or rough contact with objects. It is the lament of many a nimrod that a sight foiled his chance at a trophy or by a guide means that was knocked from alignment and went unnoticed until after the fact of a failure.

Another problem solved by the guide of this invention is that of providing a guide means that is adjustable to fit on a diversity of bows. Hunting bows come in many configurations and usually come with an arrow guide means incorporated into the structure of the bow. Alternative guide means need to be versatile to be able to be positioned and adjusted to accommodate to the differing dimensions of hunting bows.

Another problem solved by the guide of this invention relates to sounds produced by arrows being guided by roller guides. Rotating guides made of hard rubber; plastic, or metal make sounds as they roll along an arrow shaft. Such sounds are detectable by game animals.

DESCRIPTION OF THE RELATED ART

One or more of the problems listed above are found in the following patents which represent the most relevant prior art known to the inventor at the time of preparation of this specification.

U.S. Pat. No. 221 to Peck discloses two spring biased laterally displaceable elements of metal or durable plastic that form a v-shaped guide that responds to the bending of the arrow during the propelling of the arrow from the bow. These guides produce detectable sounds in use.

U.S. Pat. No. 5,261,383 to Halamay discloses three, spring-biased rollers mounted on axles and having depressions therein that engage the shaft of an arrow and respond to the bending of the arrow during release. The three rollers serve to center the shafts of arrows of various diameters between the rollers. These guides produce detectable sounds in use.

U.S. Pat. No. 5,031,061 to Gunter discloses an arrow support having two plastic rollers supported on pivot shafts in roller support arms which are adjustably mounted in posts which are secured in a support base in a way that the positions of the rollers so that they can be adjusted to accommodate to arrows of differing diameters. These guides produce detectable sounds.

U.S. Pat. No. 5,085,201 to Tepper et al discloses the use of very narrow low friction tired wheels of hard rubber to reduce the drag on the arrow as it passes over the guides. These guides produce detectable sounds.

The prior art does not provide an arrow guide that is silent during the draw and release of an arrow.

The prior art does not provide an arrow guide that has adjustable stops and spring biasing such that the guide is resiliently displaceable and self-repositioning.

It is therefore an object of this invention to provide an arrow guide that is silent during draw and release of an arrow.

It is further an object of this invention to provide the arrow guide described above wherein the arrow guide is resiliently displaceable and self-repositioning.

It is further, an object of this invention to provide the arrow guide as described above that is adjustable for accurate positioning on many different bow structures.

Further objects will become apparent from the following specifications and claims.

BRIEF DESCRIPTION OF THE INVENTION

An arrow guide comprising: a mounting arm which is adjustably securable to a bow, a mounting shaft passing through the mounting arm and the mounting shaft is translatable and rotatable relative to the mounting arm, guide supports having mounting ends secured to the mounting shaft and free ends projecting outward from said shaft and lying in the same plane with each other, disk shaped silent running roller guides mounted on the free ends of the mounting arms so that the planes of rotation of the roller guides intersect at a line that is parallel to the longitudinal axis of an arrow resting in the v-shaped guide formed by the outer peripheries of the guides, sound muffling material secured to the outer peripheries of the guides, a coil compression spring encircling the mounting shaft and having one end secured in the mounting arm and one end secured in the guide support nearest the mounting arm, a translational stop secured to the mounting shaft and said stop is maintained in contact with the mounting arm by the resilience of the coil spring and, a rotational stop secured to the mounting arm which is maintained in contact with a stop on the mounting shaft by rotational tension in the coil spring.

DETAILED DESCRIPTION OF THE INVENTION

Figure 1:
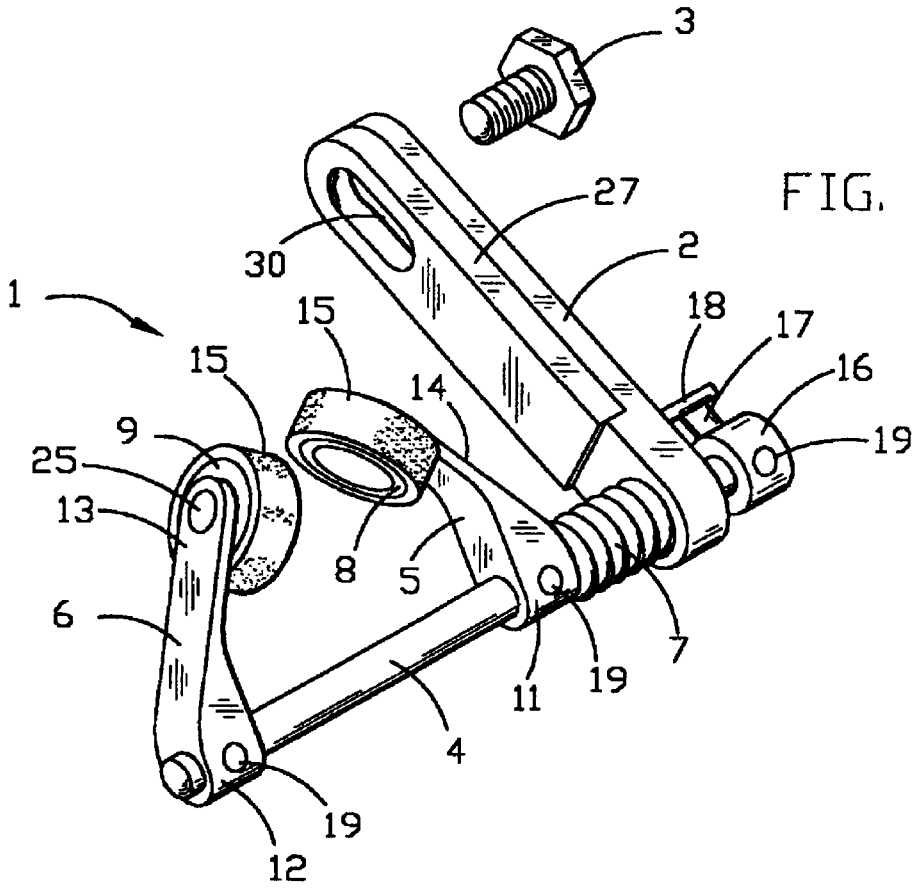
FIG. 1 is a perspective view of the guide of this invention.
Figure 2:
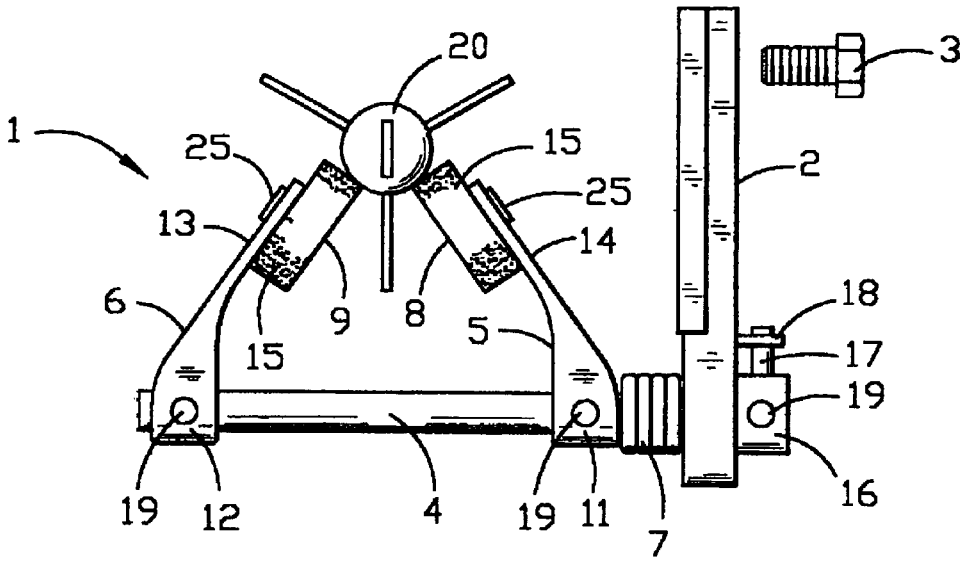
FIG. 2 is an elevational view of the guide of FIG. 1.
Figure 3:
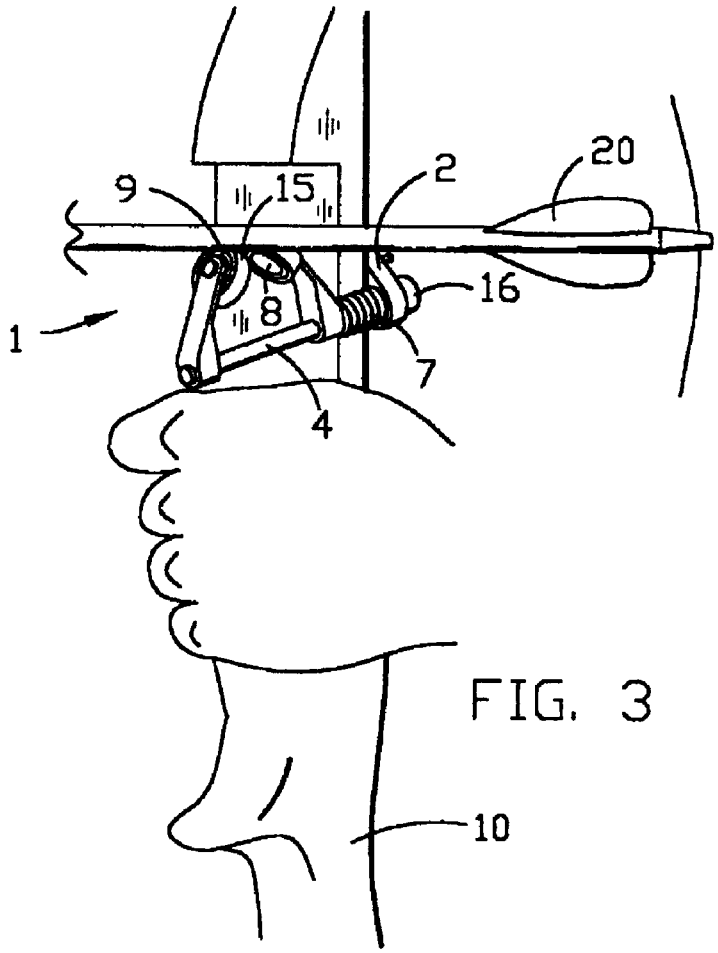
FIG. 3 is a perspective view of the guide of FIG. 1 mounted on a bow.

In the drawings like numbers refer to like objects and the proportions of some elements of the drawings have been modified to facilitate illustration.

The term "silent running" and its variants, as used herein shall be understood to mean "producing no sound detectable by human hearing at a distance of 3 feet".

Referring now to FIGS. 1–4 which show an arrow guide 1 of this invention comprising: a mounting arm 2 which is adjustably securable to a bow 10 by means of fastener 3, a mounting shaft 4 passing through mounting arm 2 and mounting shaft 4 is translatable and rotateable relative to mounting arm 2, guide supports 5 and 6 having mounting ends 11 and 12 secured to mounting shaft 4 and free ends 13 and 14 projecting outward from mounting shaft 4 and guide supports 5 and 6 lie in the same plane with each other, disk shaped silent running roller guides 8 and 9 mounted on free ends 13 and 14 of guide supports 5 and 6 so that the planes of rotation of roller guides 8 and 9 intersect at a line that is parallel to the longitudinal axis of an arrow 20 resting in the v-shaped guide formed by the outer peripheries of guides 8 and 9, sound muffling material 15 secured to the outer peripheries of the guides 8 and 9, a coil spring 7 encircling mounting shaft 4 and having one end secured in mounting arm 2 and one end secured in the guide support nearest the mounting arm, a translational stop 16 secured to mounting shaft 4 and stop 16 is maintained in contact with mounting arm 2 by the resilience of coil spring 7 and, a rotational stop 18 secured to mounting arm 2 which is maintained in contact with a stop 17 on translational stop 16 by rotational tension in coil spring 7.

In use, an arrow is knocked and rests on an arrow guide. When the quarry is spotted, the bow is drawn preparatory to launching the arrow. The drawing of the bow causes the arrow to be drawn over the guide. In prior art guides; there are three potential sources of sound as the arrow is drawn. First are the sounds generated when one surface slides along another surface. Second are the sounds of one surface rolling along another surface. Third are the sounds made when bearings rotate. It should be noted that both the bow and the arrow are capable of serving as sounding boards that can amplify sounds generated in contact with either.

Figure 4:
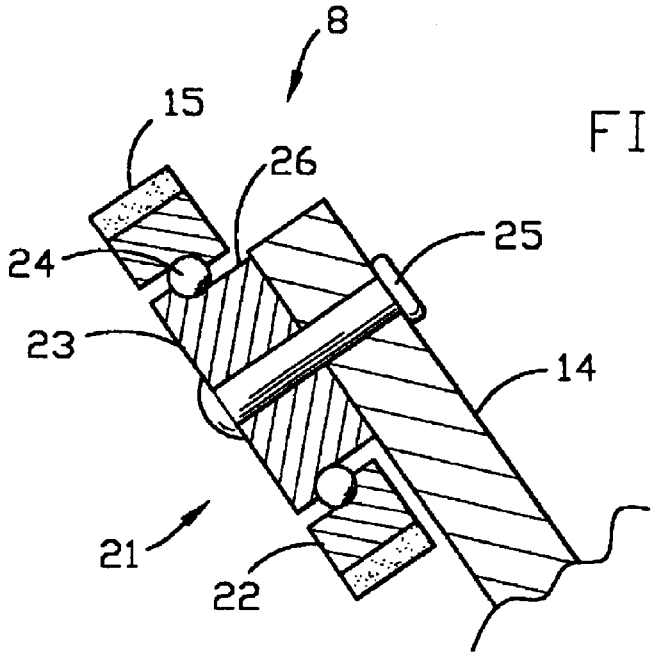
FIG. 4 is a sectional elevational view of a roller guide of this invention.

A preferred roller guide 8 of this invention is illustrated schematically in FIG. 4. Ball bearing 21 comprises outside race 22, inside race 23, and ball bearing 24. Inside race 23 is secured to free end 14 of guide support 5 by means of rivet 25. Inside race 23 is fixed relative to free end 14 and is provided with offset 26 so that outside race 22 does not contact free end 14 during rotation. Outside race 22 has sound muffling material 15 attached around its outer perimeter. Sound muffling material 15 may be felt, sponge, or any other suitable sound muffling material. While other silent running bearings will serve as arrow guides, ball bearings, or roller bearings are preferred due to their low inertia and precision.

Bearings of the type illustrated in FIG. 4 can be fabricated to run silently. Outside race 22 has a low mass and will present little inertial resistance to the rapid acceleration of arrow 20.

By using a silent running and low inertia bearing and a sound muffling contact surface between arrow and guide the inventor has successfully eliminated the three potential sources of sounds that could be generated when drawing an arrow over an arrow guide. The bearings are designed to be silent; the low inertia of the outer race of the bearing greatly reduces the potential of any sliding sounds being produced between the arrow and the guide. The provision of a sound muffling contact surface between the arrow and the guides greatly reduces the potential for sounds being generated by the guides rolling along the arrow.

To provide adjustability to accommodate to most manufactures of bows, guide supports 5 and 6 and translational stop 16 can be rotated and translated on mounting shaft 4 and secured in place by set screws 19. To provide positional adjustment mounting arm 2 is provided with slot 30 and to provide lateral adjustment, arm 2 may be provided with slotted spacer 27.

When arrow 20 is launched, the abrupt acceleration can cause arrow 20 to bow and urge guide 1 forward and down. Coil spring 7 serves to provide a resilient response to those forces and stops 17 and 18 working in conjunction with forces exerted in spring 7, to return guide 1 to its original position. Spring 7 also serves to return guide 1 to its preset position should guide 1 be accidentally displaced.

Spring 7 is a coil spring and surrounds mounting shaft 4 and has its first end anchored in mounting arm 2 and its second end anchored in guide support 5, which is the guide support closest to mounting arm 2.

The above disclosures would enable one skilled in the art to make and use the arrow guide of this invention without undue experimentation. However the invention admits of numerous variations that do not depart from the inventive concept. Therefore, the scope of this invention should not be limited to the scope of the embodiment disclosed above. The scope should only be limited to the scope of the appended claims and all equivalents thereto that would become obvious to one skilled in the art.

What is claimed is:

1. An arrow guide comprising:

a) a mounting arm adjustably securable to a bow, b) a mounting shaft passing through the mounting arm, c) two guide supports having mounting ends and the mounting ends are secured to the mounting shaft and the guide supports have free ends projecting outward from the mounting shaft and the guide supports lie in the same plane with each other, d) disk-shaped silent running roller guides mounted on the free ends of the guide supports so that the planes of rotation of the roller guides intersect at a line that is parallel to the longitudinal axis of an arrow resting in a v-shaped guide formed by the outer peripheries of the roller guides, e) sound muffling material secured to the outer peripheries of the roller guides, and f) the roller guides are ball bearings and their peripheries are in the form of a cylinder.

2. The guide of claim 1 wherein the guide supports are translatable and rotatable on the mounting shaft and the mounting shaft is provided with a translational stop adjacent to the mounting arm and the guide supports and the translational stop is securable to the mounting shaft by means of threaded fasteners.

3. The guide of claim 2 wherein the mounting shaft is provided with a coil spring surrounding the mounting shaft and the coil spring has a first end and a second end and the coil spring is positioned on the mounting shaft between the mounting arm and the guide support nearest to the mounting arm and the first end of the coil spring is secured to the mounting arm and the second end is secured to the guide support nearest to the mounting arm.

4. The guide of claim 3 wherein the translational stop is provided with a stop projecting radially outward from the translational stop positioned to engage with a rotational stop projecting outward from the mounting arm and wherein the stops are maintained in engagement by a rotational bias in the coil spring.

5. An arrow guide comprising:

a) a mounting arm adjustably securable to a bow, b) a mounting shaft passing through the mounting arm, c) two guide supports having mounting ends and the mounting ends are secured to the mounting shaft and the guide supports have free ends projecting outward from the mounting shaft and the guide supports lie in the same plane with each other, d) disk-shaped silent running roller guides mounted on the free ends of the guide supports so that the planes of rotation of the roller guides intersect at a line that is parallel to the longitudinal axis of an arrow resting in a v-shaped guide formed by the outer peripheries of the roller guides, and e) sound muffling material secured to the outer peripheries of the roller guides, and f) the roller guides are roller bearings and their peripheries are in the form of a cylinder.

* * * * *